United States Patent [19]

Miseki

[11] Patent Number: 4,804,838

[45] Date of Patent: Feb. 14, 1989

[54] INDUCTIVELY-COUPLED RADIO FREQUENCY PLASMA MASS SPECTROMETER

[75] Inventor: Kozo Miseki, Kyoto, Japan

[73] Assignee: Shimadzu Corporation, Kyoto, Japan

[21] Appl. No.: 70,698

[22] Filed: Jul. 7, 1987

[30] Foreign Application Priority Data

Jul. 7, 1986 [JP] Japan ..... 61-104100[U]

[51] Int. Cl.[4] ..... H01J 49/36

[52] U.S. Cl. ..... 250/288; 250/281; 250/423 R; 315/111.21

[58] Field of Search ..... 250/288, 281, 282, 423 R; 315/111.21, 3.5, 111.81

[56] References Cited

U.S. PATENT DOCUMENTS

| | | | |
|---|---|---|---|
| 4,277,746 | 7/1981 | Abe et al. | 324/133 |
| 4,392,083 | 7/1983 | Costello | 315/85 |
| 4,501,965 | 2/1985 | Douglas | 250/288 |
| 4,682,026 | 7/1987 | Douglas | 250/288 |
| 4,746,794 | 5/1988 | French et al. | 250/288 |
| 4,760,253 | 7/1988 | Hutton | 250/288 |

*Primary Examiner*—Carolyn E. Fields
*Assistant Examiner*—John A. Miller
*Attorney, Agent, or Firm*—Birch, Stewart, Kolasch & Birch

[57] ABSTRACT

An inductively-coupled radio frequency plasma mass spectrometer comprises an induction coil for generating a high frequency magnetic field, a plasma torch for causing a plasma by introducing an aerosol therein, and an electrostatic shield, interposed between the induction coil and the plasma torch, for shielding off the plasma from the electric field by the induction coil.

5 Claims, 2 Drawing Sheets

(a)

(b)

INDUCTIVELY-COUPLED RADIO FREQUENCY PLASMA MASS SPECTROMETER

BACKGROUND OF THE INVENTION

The present invention relates to an inductively-coupled radio frequency plasma mass spectrometer for mass analysis with an inductively-coupled radio frequency plasma as an ion source.

Conventionally, an inductively-coupled radio frequency plasma mass spectrometer is more suitable for microanalyses than an inductively-coupled radio frequency plasma emission spectro-analyzer because of its high sensitivity. Further, the former is suitable for analyzing isotope, so that wide applications have been recently developed.

The inductively-coupled radio frequency plasma mass spectrometer comprises an apparatus such that an induction coil is provided through which radio frequency current flows, and where aerosol is introduced into a plasma torch to thereby generate an inductively-coupled radio frequency plasma (referred to as "ICP" hereinbelow). Ions are thereby generated and introduced into a mass spectrometer, so that the mass of the ions can be analyzed.

In the conventional type of the above-descrived mass spectrometer, the energy of the ions developed by the ICP is too high to afford sufficient resolution in the mass spectrometer. FIG. 3(*a*) shows a graph representing the spectra of the energy of the ions. As shown in FIG. 3(*a*), the spectra of the energy of the ions is so wide that the ion beam cannot be focused enough by a lens system leading the ion beam to the mass spectrometer, whereby the signal output is relatively low. Further, while the ion taken out of the plasma is introduced into a vacuum chamber containing the mass spectrometer therein via an orifice, the voltage of the plasma is varied so that a pinch discharge is caused between the ICP and the orifice. The orifice may be damaged. A ultra violet ray noise may be caused because of the pinch discharge, so that the accuracy of the mass spectrometer may be influenced. No improved mass spectrometer has yet been presented to resolve the above problems.

SUMMARY OF THE INVENTION

Accordingly, it is an object of the present invention to provide an improved inductively-coupled radio frequency plasma mass spectrometer for restricting the voltage variation of ions to thereby enhance the resolution of the mass spectrometer.

It is another object of the present invention to provide an improved inductively-coupled radio frequency plasma mass spectrometer for efficiently preventing a pinch discharge between an inductivelycoupled radio frequency plasma and an orifice leading ions to a vacuum chamber in which a mass spectrometer is disposed. Briefly described, in accordance with the present invention, an inductively coupled radio frequency plasma mass spectrometer comprises an induction coil for generating a radio frequency magnetic field, a plasma torch for introducing an aerosol and causing a plasma therein, and an electrostatic shield interposed between the induction coil and the plasma torch for shutting off the plasma from the electric field by the induction coil.

BRIEF DESCRIPTION OF THE DRAWINGS

The present invention will become more fully understood from the detailed description given hereinbelow and accompanying drawings which are given by way of illustration only, and thus are not limitative of the present invention and wherein.

DESCRIPTION OF THE PREFERRED EMBODIMENT

Figure 1:
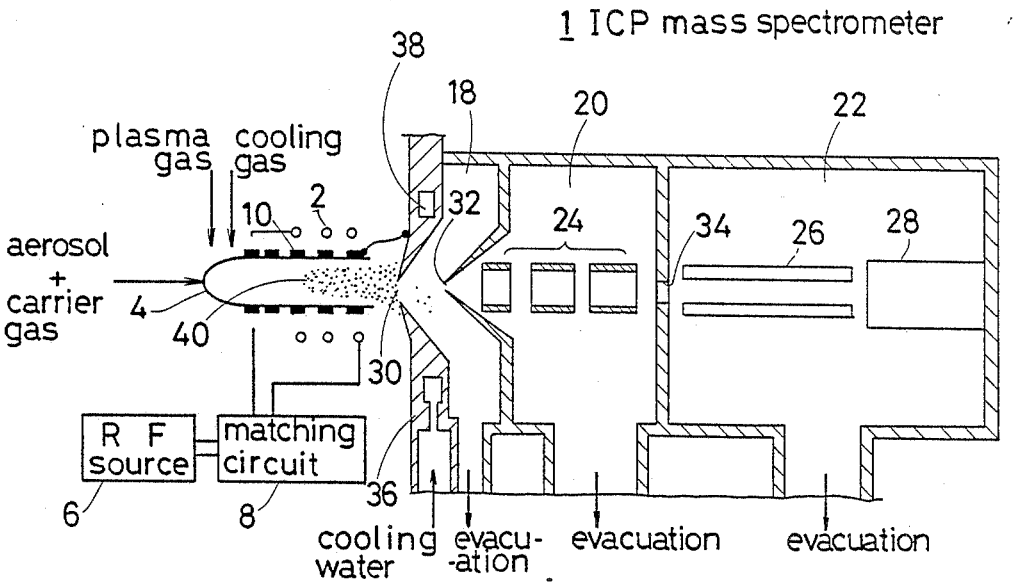
FIG. 1 is a sectional view of an inductively-coupled radio frequency plasma mass spectrometer according to the present invention.

FIG. 1 shows the construction of an inductively-coupled radio frequency plasma mass spectrometer 1 according to the present invention. The mass spectrometer 1 comprises an induction coil 2 for generating a radio frequency magnetic field, a plasma torch 4 being a crystal tube to which aerosol is introduced, a radio frequency source 6 for providing radio frequency power to the induction coil, and a matching circuit 8 for affording an impedance matching.

According to a feature of the present invention, an electrostatic shield 10 is interposed, between the induction coil 2 and the plasma torch 4, for shutting off the electric field by the induction coil 2.

Figure 2:
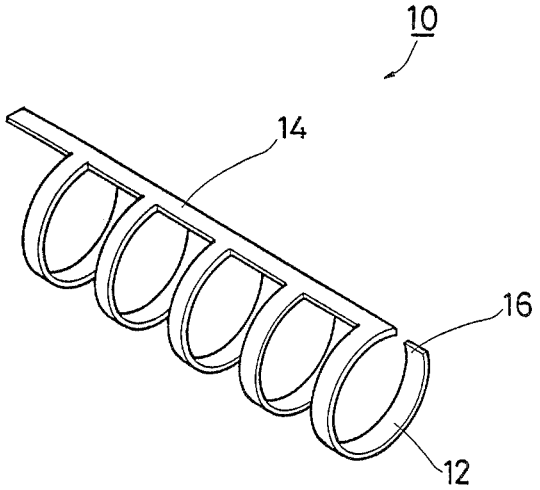
FIG. 2 is a perspective view of an electrostatic shield used for the mass spectrometer of FIG. 1.

FIG. 2 is a perspective view of the electrostatic shield 10. The electrostatic shield 10 is provided with ring portions 12 having a predetermined distance from each other and an elongated support member 14 for connecting the ring portions 12. Each of the ring portions 12 is cut away to thereby form an open end 16, so that the ring portions 12 function as an open loop to an induction current. When the electrostatic shield 10 is attached to the outside of the plasma torch 4, the electrostatic shield 10 is connected to a wall 36 of a first vacuum compartment 18 and is grounded thereby. As far as the electrostatic shield 10 has no closed loop to the induction current, the structure of the electrostatic shield 10 should not be limited to the above-described one.

First, second, and third vacuum compartments 18, 20, and 22 are provided. For example, the first vacuum compartment 18 is evacuated by a rotary pump while the second and the third vacuum compartments 20 and 22 are evacuated differentially by a diffusion pump. A lens system 24 is positioned within the second vacuum compartment 20. A quadrapole mass spectrometer 26 is positioned within the third vacuum compartment 22. An ion detector 28 is also positioned within the third vacuum compartment 22. A first orifice 30 is provided between the plasma torch 4 and the first vacuum compartment 18, a second orifice 32 is provided between the first vacuum compartment 18 and the second vacuum compartment 20, and a third orifice 34 is provided between the second vacuum compartment 20 and the third vacuum compartment 22. Within the wall 36 of the first vacuum compartment 18, on which the first orifice 30 is provided, a cooling water pathway 38 is formed to cool the wall 36 against the plasma of a high temperature.

Figure 3:
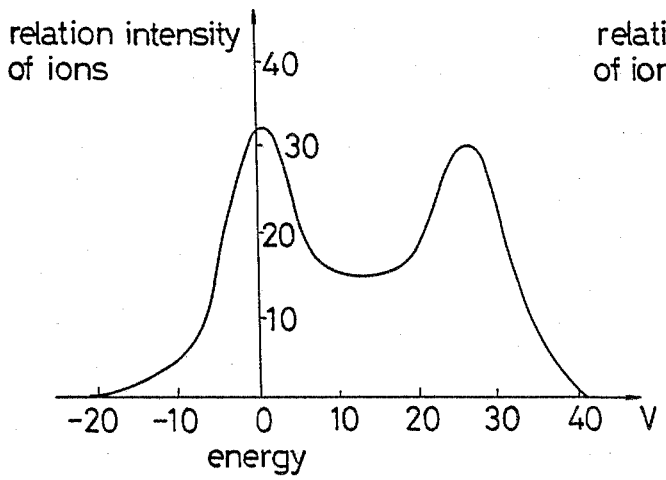
FIGS. 3(*a*) and 3(*b*) are graphs representative of the energy distribution of ions provided by the conventional type of mass spectrometer and the mass spectrometer of the present invention, respectively.
Figure 3:
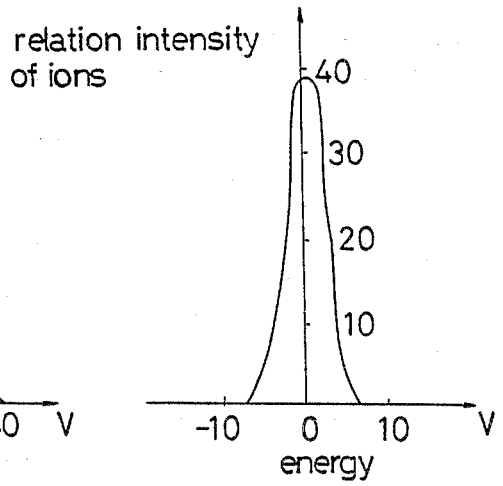

With the inductively-coupled radio frequency plasma mass spectrometer 1, a plasma 40 caused within the plasma torch 4 is shielded from the electric field by the induction coil 2 with the help of the electrostatic shield 10, so that the voltage of the plasma 40 is kept substantially identical with the ground level of the electrostatic shield 10. Therefore, a voltage variation of the ions generated is prevented. The energy of the ions caused from the plasma 40 can be lowered. Further, as shown in FIG. 3(*b*), the width of the energy of the ions becomes narrow. Hence, the resolution of the mass spectrometer 26 can be improved. The pinch discharge caused between the plasma torch 4 and the first orifice 30 can be restricted to thereby prevent the generation of a ultraviolet ray noise.

An introduction current must flow within the plasma 40 due to a high frequency magnetic field generated with the induction coil 2 in order to maintain the plasma 40. If an electrostatic shield was shaped of a closed loop, an induction current would flow within the electrostatic shield, so that the high frequency magnetic field within the plasma torch 4 would be weakened to make it difficult to maintain the plasma 40. According to the present invention, the electrostatic shield 10 has an open end portion 16 to act as a open loop for the induction currents, so that no induction current can flow within the electrostatic shield 10. Therefore, the high frequency magnetic field within the plasma torch 4 will be influenced by the electrostatic shield 10.

According to the inductively-coupled radio frequency plasma mass spectrometer of the present invention, the electrostatic shield 10 is grounded, so that the plasma is shut off from the electric field by the induction coil with the help of the electrostatic field. The voltage of the plasma is substantially grounded as in the electrostatic shield. The voltage variation of the ions caused is restricted, and the energy of the ions taken out of the plasma is lowered while the energy width of the ions becomes narrow. Therefore, the resolution of the mass spectrometer can be improved. The pinch discharge between the ICP and the orifice can be prevented to thereby restrict the ultraviolet ray noise, resulting in the increase of the analysis accuracy and the prolongation of the life time of the orifice.

While only certain embodiments of the present invention have been desdribed, it will be apparent to those skilled in the art that various changes and modifications may be made therein without departing from the spirit and scope of the invention as claimed.

What is claimed is:

1. An inductively-coupled radio frequency plasma mass spectrometer comprising:

induction coil means for generating a high frequency magnetic field:

plasma torch means for introducing aerosol therein and generating a plasma; and electrostatic shield means comprised of an open loop structure, interposed between said induction coil means and said plasma torch means, for shielding the plasma from the electric field of said induction coil means.

2. The mass spectrometer as set forth in claim 1, wherein said electrostatic shield means is attached to the outside of said plasma torch means and grounded.

3. The mass spectrometer as set forth in claim 1, wherein said plasma torch means is operated to cause a plasma therein with the aid of said induction coil means and said electrostatic shield means is maintained substantially at ground level so as to electrically isolate the plasma from the electric field caused by said induction coil means, so that the voltage variations of ions caused are restricted.

4. The mass spectrometer as set forth in claim 1, wherein said electrostatic shield means comprises a plurality of ring portions each having an open end, and an elongated support member for connecting the plurality of ring portions.

5. The mass spectrometer as set forth in claim 2, wherein said electrostatic shield means is coupled to a wall of a vacuum compartment means, said compartment means having orifice means through which ions are taken out of the plasma generated within said plasma torch means.

* * * * *